US012123120B2

(12) United States Patent
Chapman et al.

(10) Patent No.: US 12,123,120 B2
(45) Date of Patent: Oct. 22, 2024

(54) BEAM BRAKE SYSTEM AND METHOD

(71) Applicant: COLUMBIA INSURANCE COMPANY, Omaha, NE (US)

(72) Inventors: Roy Chapman, Adairsville, GA (US); David Edward Voyles, Cleveland, TN (US); Zachary Hall, Dalton, GA (US); Bryan Day, Dalton, GA (US); Joel Kitchens, Dalton, GA (US)

(73) Assignee: Columbia Insurance Company, Omaha, NE (US)

( * ) Notice: Subject to any disclaimer, the term of this patent is extended or adjusted under 35 U.S.C. 154(b) by 184 days.

(21) Appl. No.: 17/506,766

(22) Filed: Oct. 21, 2021

(65) Prior Publication Data

US 2022/0120003 A1 Apr. 21, 2022

Related U.S. Application Data

(60) Provisional application No. 63/094,677, filed on Oct. 21, 2020.

(51) Int. Cl.

| | |
|---|---|
| ***D05C 15/18*** | (2006.01) |
| ***B65H 49/34*** | (2006.01) |
| ***D02H 5/00*** | (2006.01) |

(52) U.S. Cl.

CPC ..... *D05C 15/18* (2013.01); *B65H 49/34* (2013.01); *D02H 5/00* (2013.01); *B65H 2403/7253* (2013.01); *B65H 2701/31* (2013.01)

(58) Field of Classification Search

CPC .. D02H 1/00; D02H 3/00; D02H 5/00; D02H 13/22; D02H 13/12; D02H 13/14; D02H 13/30; D02H 13/00; D05C 15/08; D05C 15/18; B65H 49/34; B65H 49/32; B65H 49/324; B65H 59/04; B65H 59/043; B65H 59/046; B65H 2403/725; B65H 2403/7253; B65H 2701/31; B65H 2701/38

USPC ..... 28/190–200; 242/410–423.2, 156–156.2

See application file for complete search history.

(56) References Cited

U.S. PATENT DOCUMENTS

| | | | | | |
|---|---|---|---|---|---|
| 259,789 | A * | 6/1882 | Anthony | B65H 23/063 | 28/194 |
| 1,031,487 | A * | 7/1912 | Taylor | B65H 59/04 | 28/186 |
| 1,401,655 | A * | 12/1921 | Sipp | D02H 3/02 | 188/77 R |
| 1,462,604 | A * | 7/1923 | Lavalle | D03D 49/08 | 139/109 |
| 1,536,047 | A * | 5/1925 | Arnold, Jr. | D02H 13/00 | 28/194 |

(Continued)

FOREIGN PATENT DOCUMENTS

GB 968383 A * 9/1964

*Primary Examiner* — Amy Vanatta

(74) *Attorney, Agent, or Firm* — Ballard Spahr LLP

(57) ABSTRACT

A system for braking rotational movement of at least one beam is disclosed. The system can comprise a frame and at least one beam rotatably supported on the frame. Each beam of the at least one beam can comprise at least one sheave groove on at least one longitudinal end. A rope can have a first end and a second end. Each of the first end and second end can be fixedly coupled to the frame. The rope can be received within a portion of at least one of the at least one sheave groove of each beam. A tensioning assembly can be configured to selectively cause a predetermined braking tension in the rope.

18 Claims, 10 Drawing Sheets

(56) References Cited

U.S. PATENT DOCUMENTS

| | | | | | |
|---|---|---|---|---|---|
| 2,252,419 | A * | 8/1941 | Slaughter | D02H 3/00 | 242/423.1 |
| 2,460,569 | A * | 2/1949 | Burrum | D03D 49/08 | 28/194 |
| 2,499,888 | A * | 3/1950 | Taylor | B65H 23/105 | 87/61 |
| 3,076,618 | A * | 2/1963 | Van Hook | B65H 59/04 | 242/422.8 |
| 3,117,737 | A * | 1/1964 | Ball | D02H 13/00 | 188/77 R |
| 3,871,205 | A * | 3/1975 | Fenton | D07B 5/12 | 57/309 |
| 4,038,805 | A * | 8/1977 | Holladay | H02G 11/02 | 53/118 |
| 4,118,842 | A * | 10/1978 | Norris | D06B 11/0036 | 139/440 |
| 5,133,513 | A * | 7/1992 | Cassidy | B65H 59/04 | 188/77 R |
| 5,524,834 | A * | 6/1996 | Bogucki-Land | B65H 59/04 | 242/147 M |
| 2015/0076266 | A1* | 3/2015 | Crawford | B66D 1/38 | 242/157.1 |

* cited by examiner

BEAM BRAKE SYSTEM AND METHOD

CROSS-REFERENCE TO RELATED APPLICATION

This application claims priority to and the benefit of the filing date of U.S. Provisional Patent Application No. 63/094,677, filed Oct. 21, 2020, the entirety of which is hereby incorporated by reference herein.

FIELD

This disclosure is directed to brakes for use in textile manufacturing. As further described herein, the disclosed brakes can be used in textile manufacturing that is performed using yarn that is wound around a beam.

BACKGROUND

Most commonly, textile machines such as tufting machines conventionally use creels. However, referring to FIGS. 1 and 2, as tufted products shift to higher end products, instead of using a creel, textile machines such as tufting machines 1 can draw yarn that is wound around a beam. A plurality of beams 2 can be positioned on a rack 3, and a plurality of yarns 4 can be wound around each beam. Each beam is not typically actively driven. Rather, tension on the yarns from the tufting machine causes the beam to rotate. The beam typically has significant weight, resulting in significant rotational momentum. Accordingly, when the tufting machine stops, the beam continues to rotate, thereby causing the yarns (that extend between the beam and the tufting machine) to droop, as can be seen in FIGS. 1 and 2 as the yarns following an arcuate profile 5. This drooping provides slack so that when the tufting machine initially begins drawing yarn again, the beam does not synchronously accelerate with the tufting machine. Rather, the initial acceleration of the tufting machine 1 only takes up the slack in the yarn 4 between the tufting machine and the beam until the slack is completely attenuated, at which point the mismatched speed between the tufting machine and the beam causes an initial jolt to the beam 2. This results in uneven tension in the yarn, leading to diminished product quality and sometimes breakage. In order to minimize this jolt, the tufting machine 1 is often accelerated extremely slowly. Tufting machines 1 can be started and stopped hundreds or thousands of times every month. Accordingly, this slow acceleration leads to significant loss of productivity.

Therefore, it is desirable to have a mechanism that prevents over-rotation of the beam 2, thereby avoiding or limiting slack in the yarn.

SUMMARY

Disclosed herein is a system for braking rotational movement of at least one beam. The system can comprise a frame and at least one beam rotatably supported on the frame. Each beam of the at least one beam can comprise at least one sheave groove on at least one longitudinal end. A rope can have a first end and a second end. Each of the first end and second end can be fixedly coupled to the frame. The rope can be received within a portion of at least one of the at least one sheave groove of each beam. A tensioning assembly can be configured to selectively cause a predetermined braking tension in the rope.

Disclosed herein, a method can comprise applying a first resistance to a beam upon a condition, wherein the beam has yarn wound therearound. The yarn can be fed into a tufting machine or other textile machine.

Additional advantages of the disclosed system and method will be set forth in part in the description which follows, and in part will be understood from the description, or may be learned by practice of the disclosed system and method. The advantages of the disclosed system and method will be realized and attained by means of the elements and combinations particularly pointed out in the appended claims. It is to be understood that both the foregoing general description and the following detailed description are exemplary and explanatory only and are not restrictive of the invention as claimed.

BRIEF DESCRIPTION OF THE DRAWINGS

FIG. 6 is illustrative of the yarns when the beam is in motion with the brake system applying a resistance tension as well as when the beam is stopped by the beam brake system.

DETAILED DESCRIPTION

Figure 1:
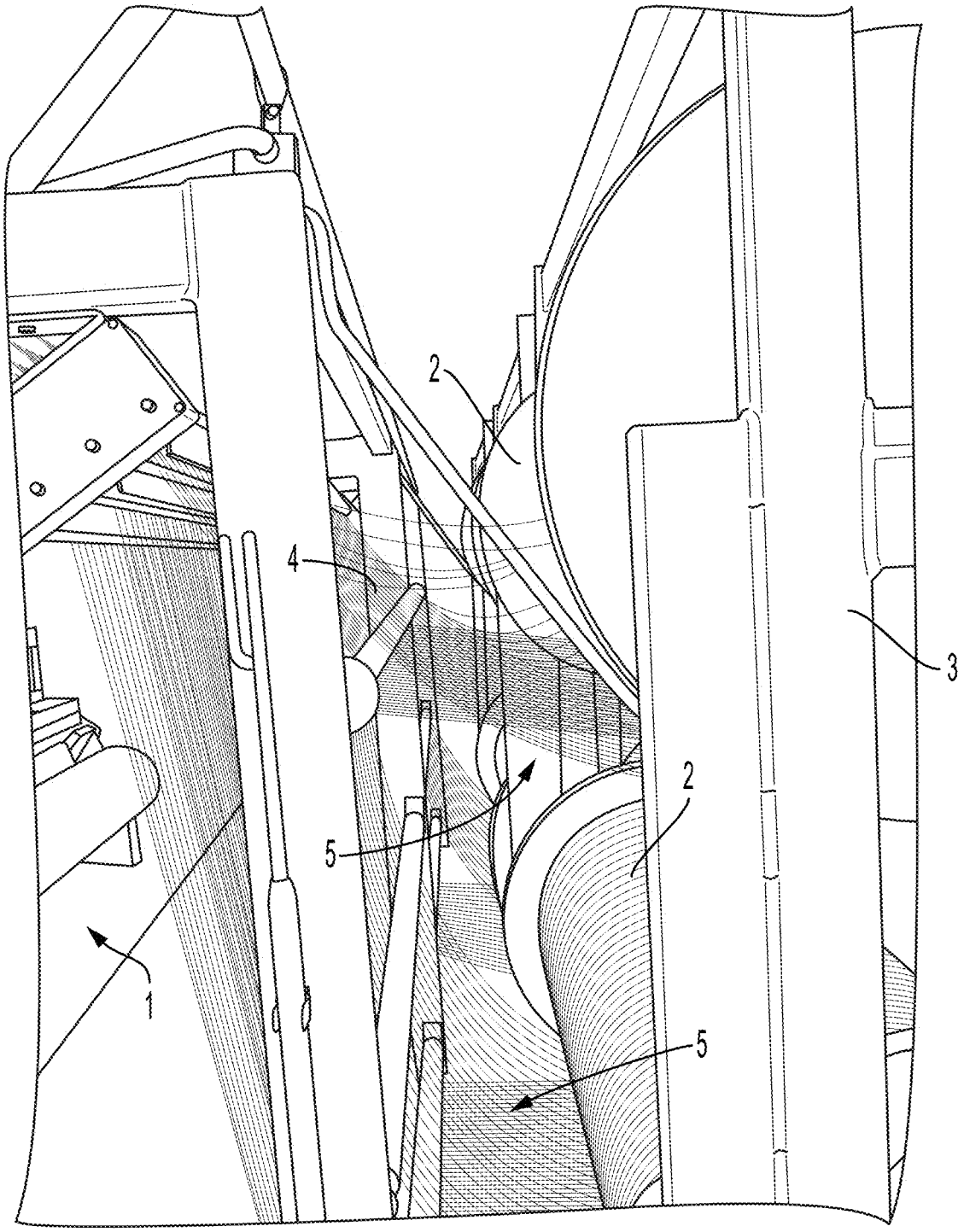
(Prior Art) FIG. 1
FIG. 1 is a side view of yarns drooping between a tufting machine and a beam of a conventional system.
Figure 2:
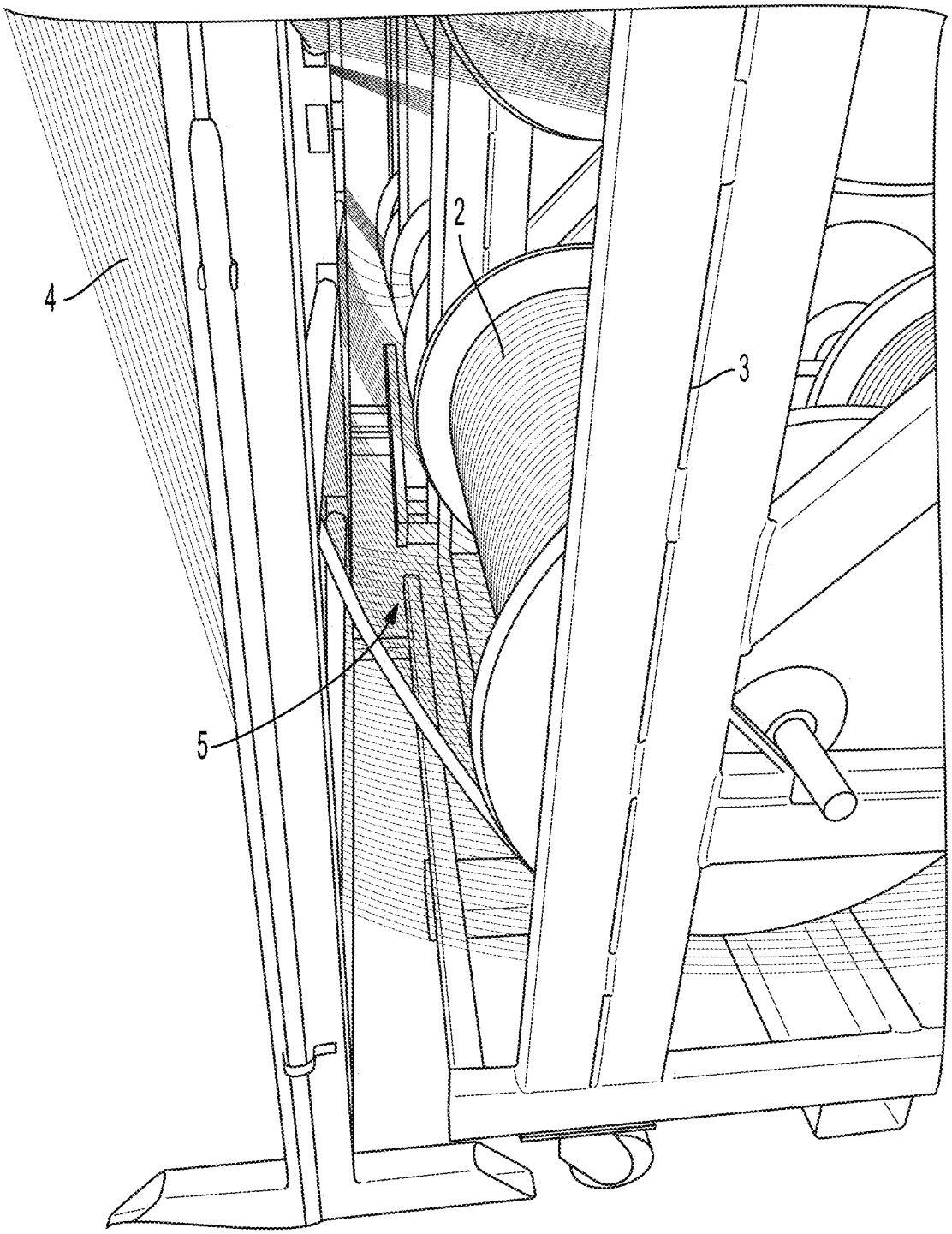
(Prior Art) FIG. 2
FIG. 2 is a side view of yarns drooping between a tufting machine and another beam of a conventional system.
Figure 3:
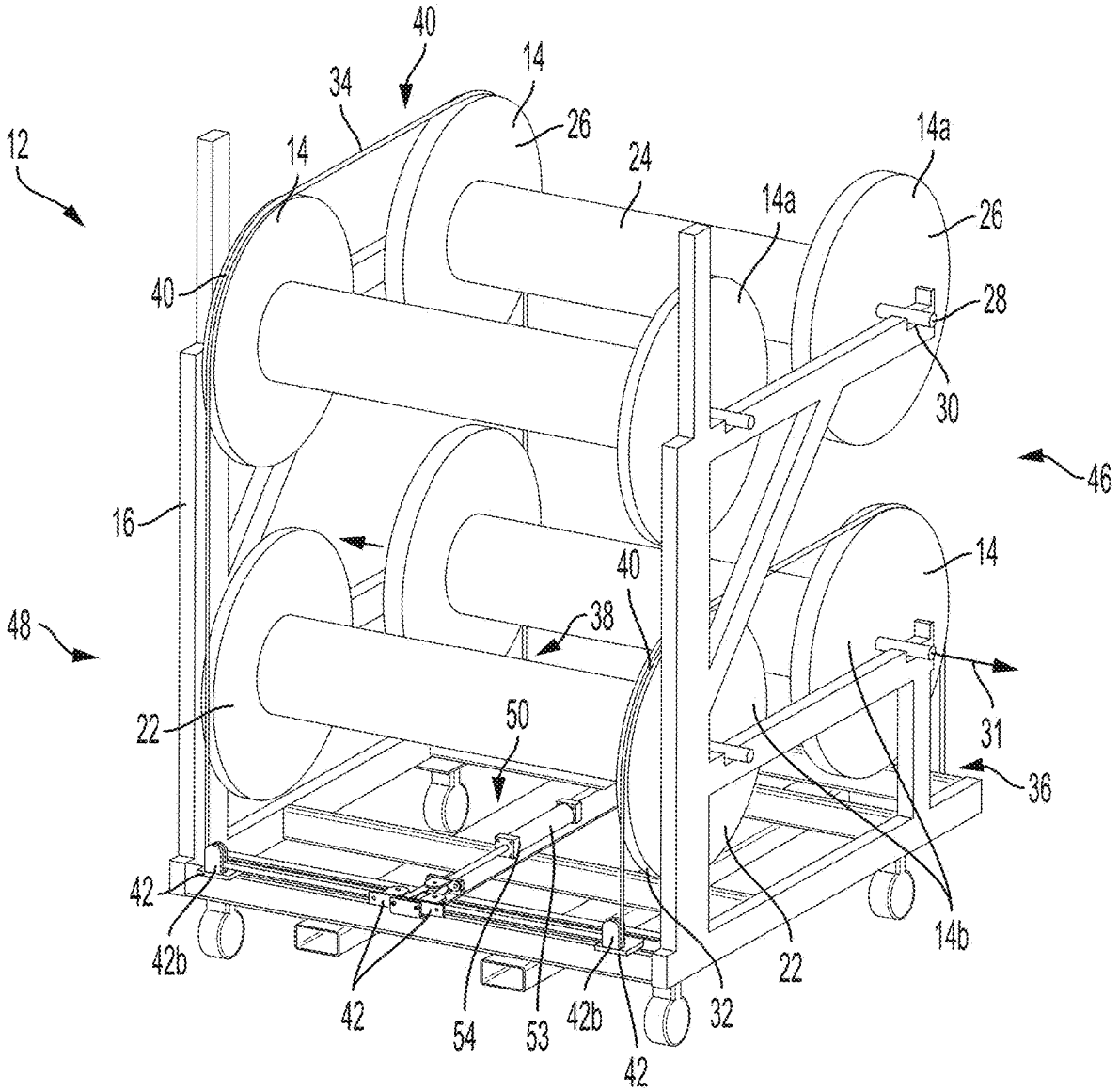
FIG. 3 is a perspective view of a beam brake system in accordance with embodiments disclosed herein.
Figure 4:
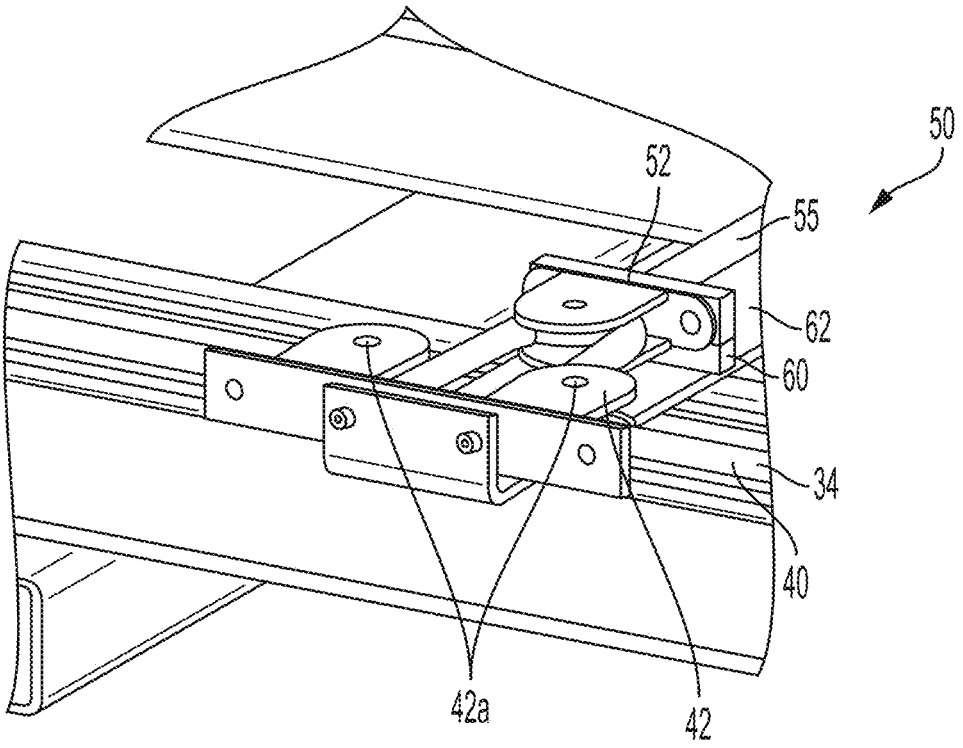
FIG. 4 is a close-up partial perspective view of a portion of the beam brake system as in FIG. 3.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present disclosure which will be limited only by the appended claims.

It must be noted that as used herein and in the appended claims, the singular forms "a," "an," and "the" include plural references unless the context clearly dictates otherwise. Thus, for example, reference to "a sheave" includes one or more of such sheaves, and so forth.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification. Thus, words denoting order, such as "first" or "next," should be interpreted as optional aspects unless plain meaning or logic dictates otherwise.

As used herein, the term "rope" should be understood to include both a length of cord made by twisting together strands of fibers (e.g., natural fibers such as hemp or artificial fibers such as polymer) as well as a strap (e.g., a leather strap or nylon fiber).

Disclosed herein and with reference to FIGS. 3-7 is a system 10 for braking (e.g., slowing or stopping) rotation of one or more beams. The system 10 can comprise a yarn transportation assembly 12 comprising one or more beams 14 (e.g., two upper beams and two lower beams) that are rotatably supported on a movable frame 16. Each beam 14 can have a plurality of yarns 18 wound therearound. The system 10 can further comprise a textile machine 20 (e.g., a tufting machine). The yarns 18 wound around the beam(s) 14 can be fed into the textile machine 20. In various aspects, each beam 14 can have opposing longitudinal ends 22 and a main body 24 that extends between the opposing longitudinal ends 22. An end plate 26 can be positioned at each end of the main body 24. The end plates 26 can extend radially outwardly from the main body 24 to retain yarn therebetween. A pivot rod 28 can extend outwardly from each end plate 26 and can be receivable into notches 30 on opposing ends of the frame 16. Each beam 14 can rotate about a respective rotational axis 31. In some optional aspects, the yarn transportation assembly 12 can comprise two upper beams 14*a* and two lower beams 14*b*, with the upper beams and lower beams being spaced along a vertical axis. The upper beams 14*a* can be spaced from each other along a first horizontal axis 6 that extends between a front and a rear of the yarn transportation assembly 12. Likewise, the lower beams 14*b* can be spaced from each other along the first horizontal axis.

Figure 8:
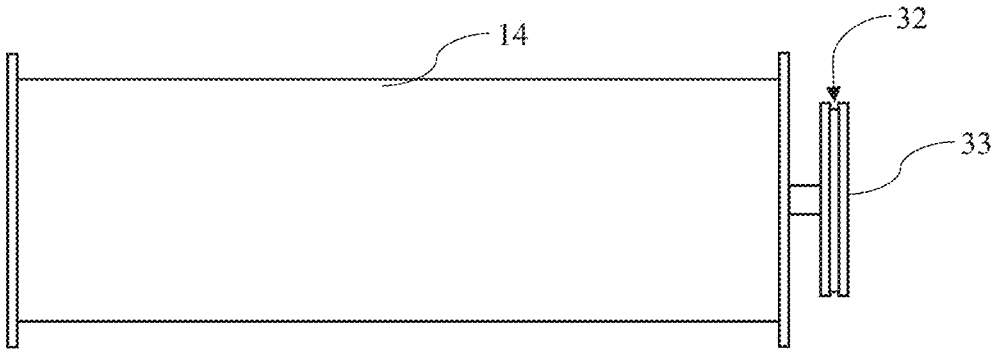
FIG. 8 is a schematic diagram of a beam comprising a sheave coupled thereto in accordance with embodiments disclosed herein.

Each beam 14 can define a sheave groove 32 on one or both longitudinal ends 22. For example, one or both end plates 26 can define a sheave groove 32 on an outer circumference of the end plate. In further aspects, a separate sheave element 33 (FIG. 8) defining the sheave groove 32 can be coupled to the rest of the beam 12 outwardly of the end plate 26. A rope 34 can have a first end 36 and a second end 38 that are fixedly coupled to the frame 16 so that the first and second ends 36, 38 cannot move relative to the frame. The rope 34 can define a rope path 40 between the first end and second end. A plurality of fixed sheaves 42 can direct the rope 34 along the rope path 40. Although the fixed sheaves 42 are shown as coupled to frame 16 via mounting plates, it is contemplated that the fixed sheaves can, in further aspects, be coupled directly to the frame.

In some optional aspects, the rope 34 can comprise a length of cord made by twisting and/or braiding together strands of fibers. The fibers can comprise natural fibers (e.g., optionally, hemp) or artificial fibers (e.g., optionally, polymer), or a combination thereof. In further optional aspects, the rope 34 can comprise Kevlar for an extended lifetime. In some optional aspects, the rope 34 can comprise a coated metal cable. In further aspects, the rope 34 can comprise a strap (e.g., a leather strap or a polymer (e.g., nylon) strap).

Along the rope path 40, the rope 34 can be received with a portion 44 of at least one of the sheave grooves 32 (or in the only sheave groove) of each beam. Optionally, the rope 34 can extend around about one quarter (i.e., about 90 degrees) of at least one sheave groove 32 of each beam 14. It is contemplated that the rope 34 can engage approximately an equal portion (e.g., arc length) of the sheave groove 32 of each beam 14. In this way, a tension in the rope 34 can bias the rope against the sheave groove(s) 32 to cause equal braking force against each beam. In some aspects, and as illustrated, the rope 34 can engage a portion of the sheave groove(s) 32 at respective longitudinal ends 22 of the lower beams on a first side 46 of the yarn transportation assembly 12 and a portion of the sheave groove(s) at respective longitudinal ends 22 of the upper beams on a second side 48 of the yarn transportation assembly.

A yarn tensioning assembly 50 can be configured to cause a predetermined braking tension in the rope 34. For example, the yarn tensioning assembly 50 can comprise a movable sheave 52 that is in engagement with the rope 34 along the rope path 40. A piston 54 (e.g., a pneumatic piston movable within a cylinder 53) can be coupled to the movable sheave 52 by a piston rod 55 and can be configured to pull the movable sheave 52 to cause the rope 34 to apply a force to the portion 44 of the sheave groove 32 of each beam 14 to thereby cause the predetermined braking tension in the rope. As can be understood, a predetermined force applied by the piston 54 to the movable sheave 52 can apply the predetermined braking tension in the rope. For example, movement of the moveable sheave 52 in a first direction can elongate a length of the rope path 40, thereby causing tension in the rope. Optionally, the movable sheave 52 can be supported by a block 60 that slides along a slide plate 62. In exemplary aspects, the block 60 can comprise one or more polymer materials, such as, for example, polytetrafluoroethylene.

In exemplary aspects, the predetermined braking tension can be between zero and 150 pounds force (lbf), or less than 50 lbf, or from about 10 to about 30 lbf.

In some aspects, the yarn transportation assembly 12 can comprise a pair of fixed sheaves 42*a* that direct the rope 34 toward the moveable sheave 25. The movable sheave 52 can be configured to move away from the fixed sheaves 42*a* when applying tension to the rope 34. Optionally, the movable sheave 52 can extend parallel (or within 15 degrees, within 10 degrees, within 5 degrees, or within 1 degree of parallel) to the first horizontal axis 6. Optionally, the moveable sheave 52 can be centered between the longitudinal ends 22 of each of the beams 14. Optionally, the moveable sheave 52 and yarn tensioning assembly 50 can be positioned below the lower beams 14*b*. In some aspects, the pair of fixed sheaves 42*a* can couple to the slide plate 62. For example, the slide plate 62 can define a flange to which the pair of fixed sheaves 42*a* couple. In further aspects, it is contemplated that the yarn tensioning assembly can be positioned anywhere along the yarn path 40.

Figure 9A:
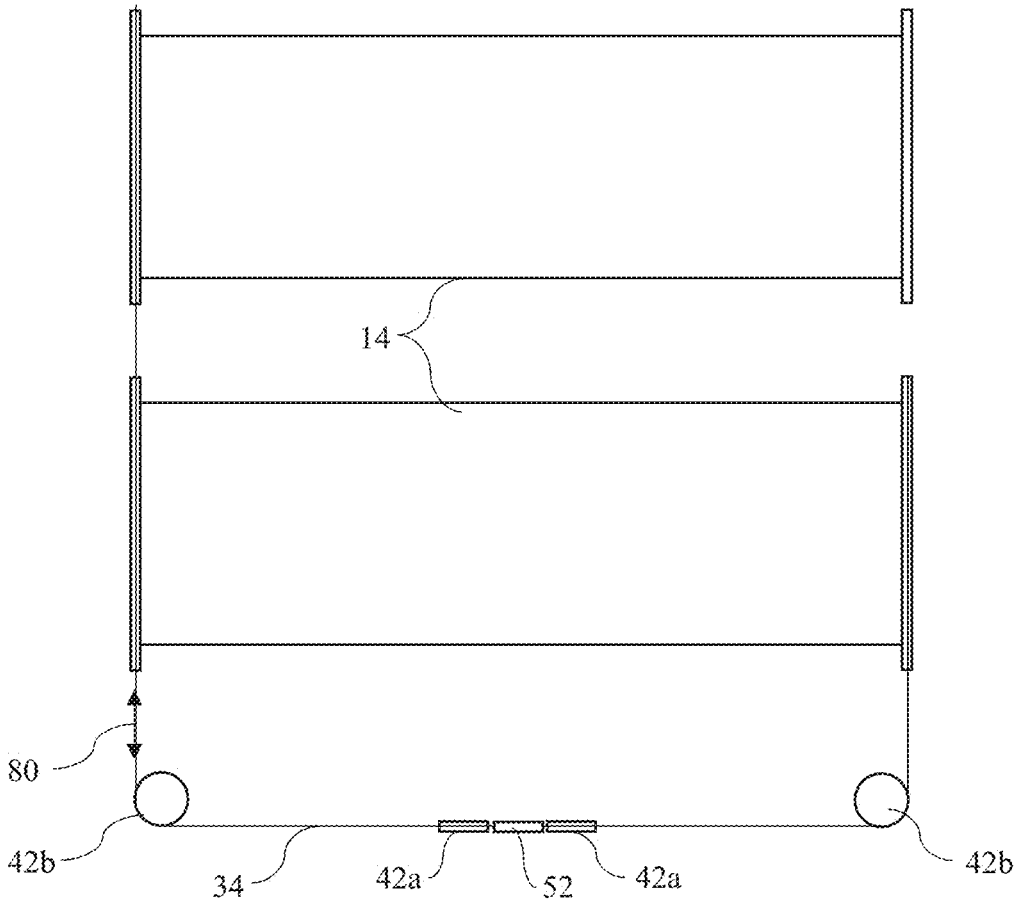
FIG. 9A is a schematic front view of a portion of a beam brake system of FIG. 3.
Figure 9B:
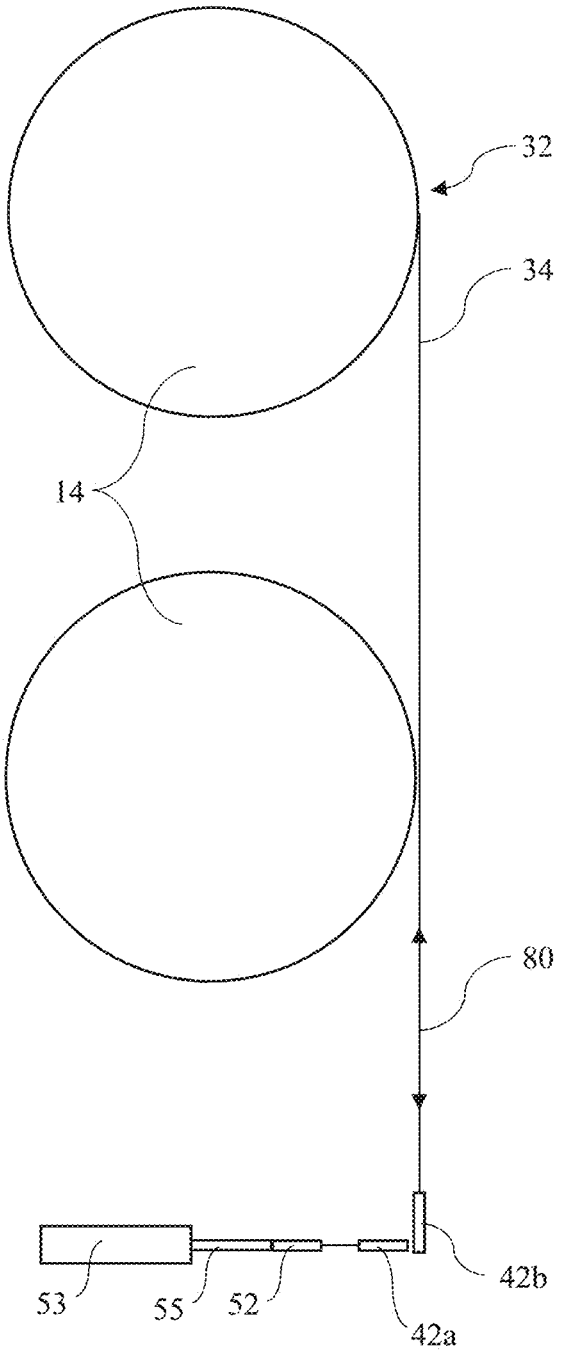
FIG. 9B is a schematic side view of a portion of the beam brake system of FIG. 3.

Referring also to FIGS. 9A-9B, in some aspects, the fixed sheaves 42 can comprise side fixed sheaves 42*b* that are positioned in line with a respective line 80 that is tangential to the sheave grooves 32 on the longitudinal ends 22 of each beam 14. Thus, in some optional aspects, the rope path 40 can extend from the first end 36 at its anchor position at the frame 16, around each of the sheave grooves 32 of the lower beams 14*b*, around a first of the pair of fixed sheaves 42*a*, around a first of the pair of fixed sheaves 42*a*, around the moveable sheave 52, around a second of the pair of fixed sheaves 42*a*, around a second of the side sheaves 42*b*, around each of the sheave grooves 32 of the upper beams 14*a*, and to the second end 38 at its anchor position at the frame 16.

Optionally, the yarn transportation assembly 12 can comprise a quick connect pneumatic coupling 102 (FIG. 6) that is in communication with the piston 54 of the tensioning assembly 50. In this way, the yarn transportation assembly 12 can be positioned proximate to the textile (e.g., tufting) machine and then quickly coupled to a pneumatic air supply line to supply air to actuate the pneumatic piston of the tensioning assembly.

Optionally, the tensioning assembly 50 can be configured to apply a predetermined resistance tension in the rope 34 that is less than the predetermined braking tension. The predetermined resistance tension can be, for example, less than half, or about one third of the predetermined braking tension. In exemplary aspects, the predetermined resistance tension can be between zero and 100 pounds force (lbf), or less than 50 lbf, or from about 5 to about 30 lbf, or from about 5 to about 20 lbf. In this way, the tensioning assembly 50 can cause the beams 14 to rotate at consistent speeds, avoiding lurching, particularly during starting and stopping of the machine. Optionally, the tensioning assembly 50 can apply the predetermined braking tension for a predetermined time after receiving the stop signal and then revert to the predetermined resistance tension. The predetermined time can be greater than the textile (e.g., tufting) machine stop time (e.g., by about one second or at least one second). For example, it can be known that an exemplary textile (e.g., tufting) machine takes about five seconds to stop, so the predetermined time can be greater than five seconds (and optionally be six seconds). For another exemplary textile (e.g., tufting) machine that takes about 10 seconds to stop, the predetermined time can be greater than 10 seconds (and optionally be 11 seconds).

Figure 5:
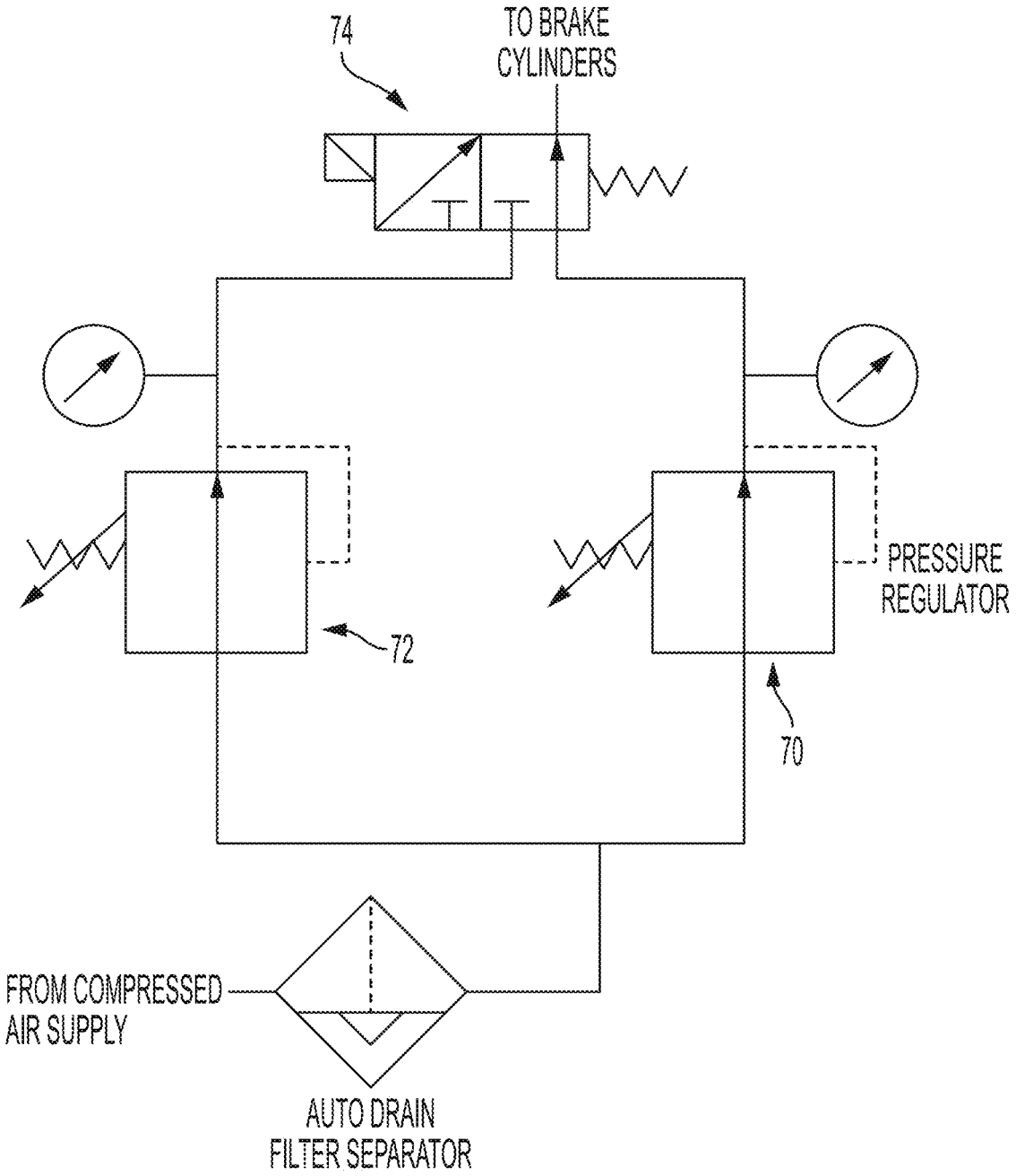
FIG. 5 is a pneumatic schematic diagram of the brake system as in FIG. 3.
Figure 6:
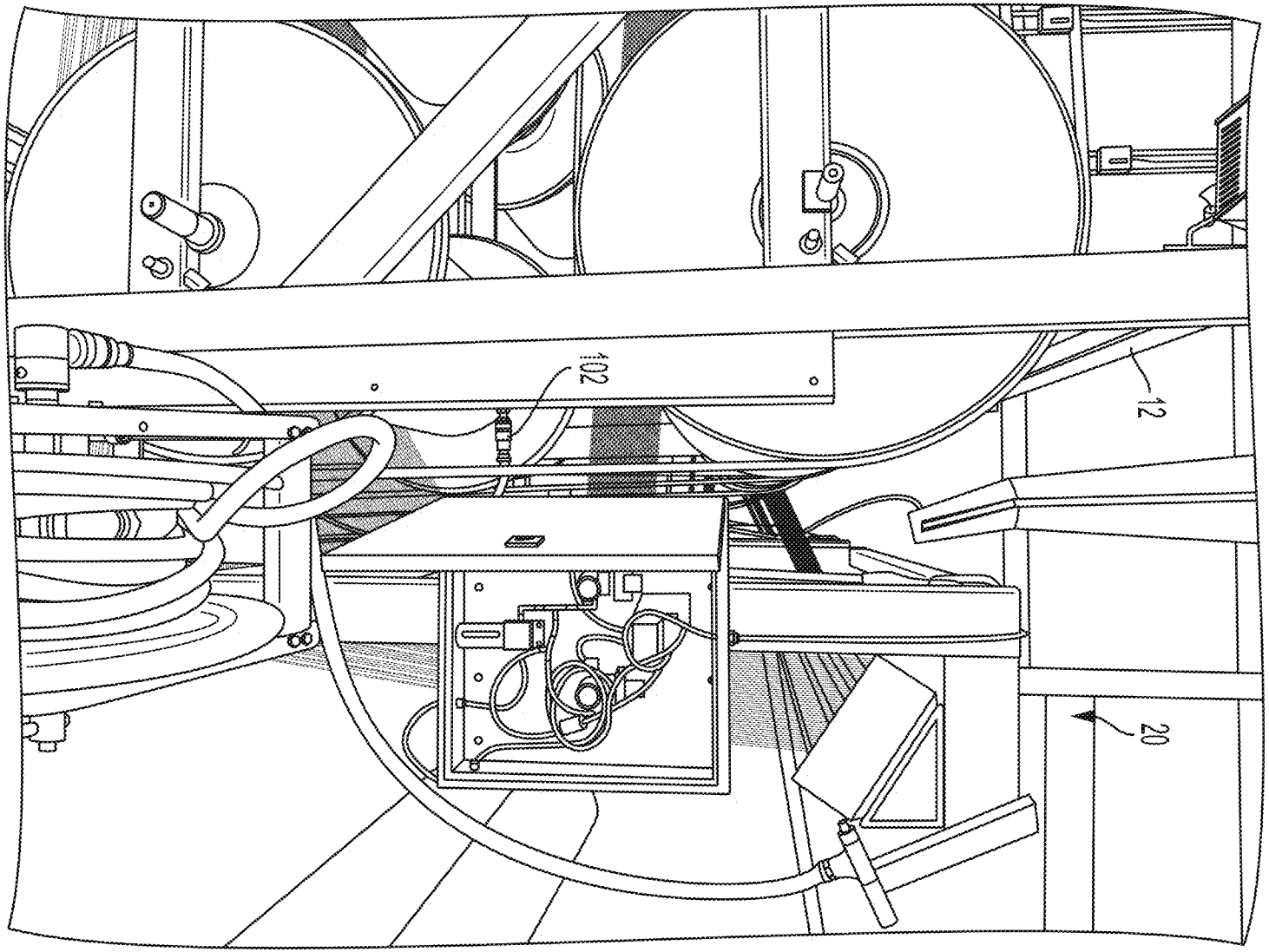
FIG. 6 is a side view of a portion of a beam brake system, showing taught yarns extending to a tufting machine.
Figure 7:
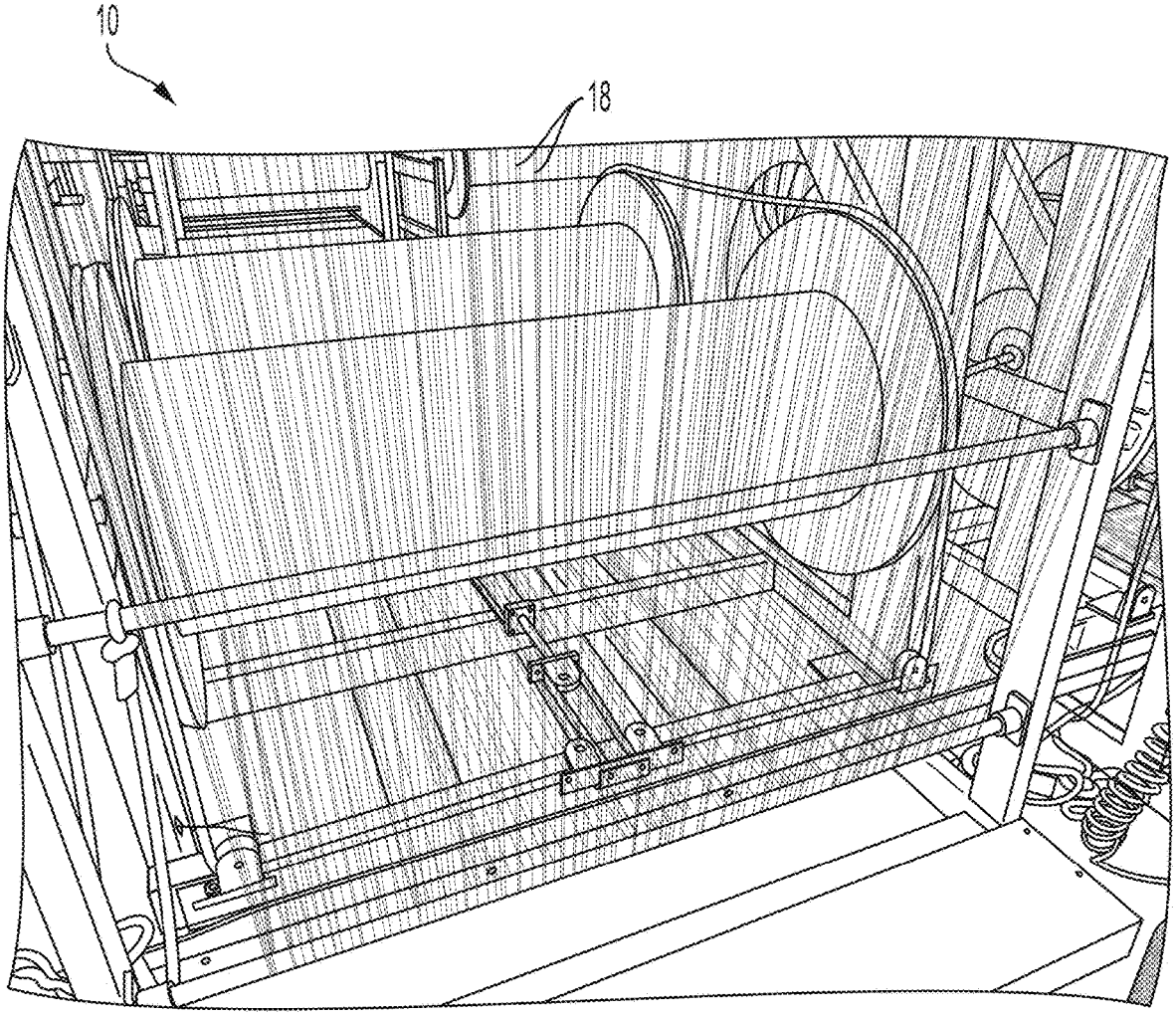
FIG. 7 is a front view of a portion of the beam brake system.

Referring to FIG. 5, the tensioning assembly 50 (FIG. 3) can comprise a first pressure regulator 70 and a second pressure regulator 72. The first pressure regulator 70 can maintain an output of a first pressure, and the second pressure regulator 72 can maintain a second pressure that is higher than the first pressure. The output of the first pressure regulator 70 can be in communication with the piston 54 (thereby causing the tensioning assembly to apply the predetermined resistance tension) until the tensioning assembly receives the stop signal. Upon receiving the stop signal, a pneumatic actuator 74 can move to cause the output of the second pressure regulator 72 to be in communication with the piston 54. Optionally, the pneumatic actuator 74 can maintain this configuration for the predetermined time and then move back to cause the output of the first pressure regulator to be in communication with the piston 54. It is further contemplated that the first pressure regulator 70 can optionally be a bleed pressure regulator (e.g., a reverse flow-capable pressure regulator that can bleed off a higher downstream pressure). In this way, the pressure regulator can allow the air pressure between the piston 54 and the output of the first pressure regulator to decrease to the first pressure when the output of the first pressure regulator is in communication with the piston. As shown, in exemplary aspects, the pneumatic actuator 74 can comprise a two-port, three position valve. It is contemplated that the use of "first" and "second" in referencing the pressure regulators is not meant to require operation in any particular order. In some aspects, both the first and second pressure regulators 70, 72 can be bleed pressure regulators.

Figure 10:
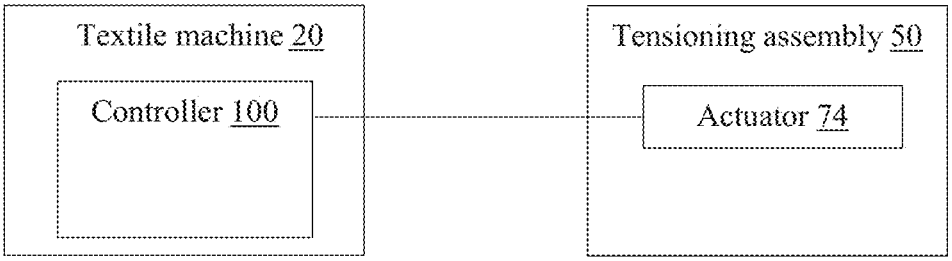
FIG. 10 is a schematic diagram of a control system for actuating the brake system as disclosed herein.

Referring to FIG. 10, the tensioning assembly 50 can be actuated by a stop signal. For example, the tensioning assembly can be in electrical communication with the textile (e.g., tufting) machine 20 so that a stopping of the textile machine (e.g., a depression of a stop button on the textile machine or the sensing of the stoppage of operation (e.g., motion) of the textile machine) can provide the stop signal (e.g., an electrical stop signal) that actuates the tensioning assembly 50. For example, in exemplary aspects, the textile (e.g., tufting) machine 20 can comprise a controller 100 (e.g., a programmable logic controller (PLC)). The controller 100 can be in communication with the pneumatic actuator 74. The controller 100 can be configured to actuate the pneumatic actuator 74 (e.g., via a relay or other switch) to apply the braking tension. In further aspects, the controller 100 can be separate from the textile machine (e.g., the controller 100 can be provided as a central processor). The controller 100 can be configured to receive a stop signal from the textile machine 20 and, in response, actuate the pneumatic actuator 74 or otherwise actuate the tensioning assembly 50. In exemplary aspects, the controller 100 can be configured to start a timer for the predetermined time after actuating the pneumatic actuator 74 and, after expiration of the predetermined time, actuate the pneumatic actuator 74 to cause the tensioning assembly 50 to apply the resistance tension.

It is contemplated that the braking tension can still allow the beam(s) 14 to rotate to inhibit breaking of the yarns or lateral movement or tipping of the yarn transportation assembly 12 if the textile (e.g., tufting) machine 20 continues movement while the rope 34 is applying the braking tension to the beam(s).

Figure 11:
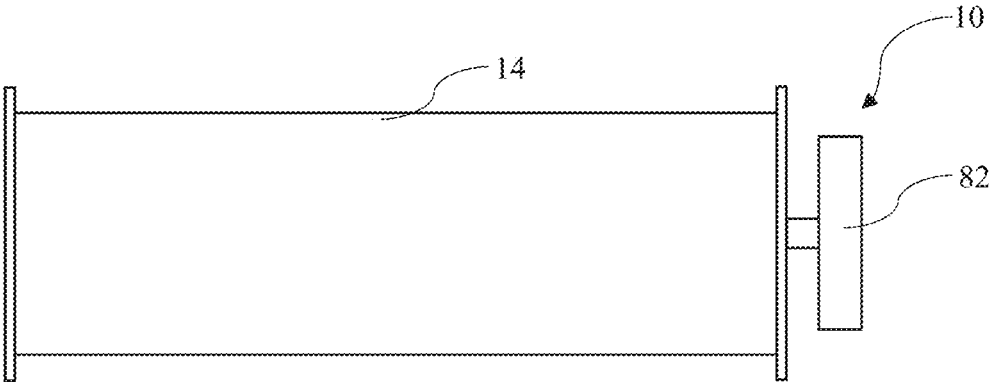
FIG. 11 is an exemplary beam brake system having a drive that is coupled to a beam for starting and slowing rotation of the beam.

Referring to FIG. 11, in further optional aspects, each beam 14 can comprise a respective drive 82 that is configured to cause and stop rotation of each beam (e.g., through motor control).

The system 10 can be used for slowing rotation of one or more beams having yarn wound therearound. A method can comprise applying a first resistance to rotation of a beam upon a condition (e.g., upon the occurrence or detection of the condition), wherein the beam has yarn wound therearound. The yarn can be fed into a textile (e.g., tufting) machine. The first resistance to rotation of the beam can reduce a feed rate of yarn from the beam. In some aspects, applying the first resistance to the beam upon the condition can comprise applying tension to a rope that is received within at least a portion of the sheave groove. Thus, the resistance can be a frictional force associated with drag between the rope and the sheave groove. It is contemplated that the frictional force can change as a function of rate of rotation of the beam.

In some optional aspects, the condition can be an electrical signal, such as, for example, the stop signal as disclosed herein. Optionally, the electrical signal (e.g., stop signal) can be received from (e.g., provided by a sensor or processing component of) the textile (e.g., tufting) machine. In exemplary aspects, the electrical signal (e.g., stop signal) can be provided by a programmable logic controller (PLC) of the textile machine as further disclosed herein. In use, when the textile machine is stopped (for example, by the pressing of a stop button as disclosed herein), the sensor or processing component (e.g., PLC) of the textile machine can generate the electrical signal.

The method can further comprise applying a second resistance to the beam after applying the first resistance to the beam. The second resistance can be lower than the first resistance. Optionally, the second resistance to rotation of the beam can be applied a predetermined time after occurrence of the condition. In some aspects, the predetermined time (after which the second resistance is applied) can be greater than a stopping time of the textile (e.g., tufting) machine. As further described herein, stopping of a textile machine is a gradual process, having a decreasing yarn in-feed rate, wherein the textile machine fully stops several seconds (e.g., about five seconds) after initiating a stopping routine. By delaying the application of the second resistance until after the stopping time of the textile machine, the first (braking) resistance can be applied while the textile machine is slowing down, and the second resistance can be applied after the textile machine has fully stopped. Optionally, as further disclosed herein, it is contemplated that the second resistance can be applied both before occurrence of the condition and after the predetermined time following occurrence of the condition, such that the disclosed system applies the second (lesser) resistance both before and after application of the first (higher, braking) resistance.

In some optional aspects, the beam can be one of a plurality of beams positioned on a rack.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A system comprising:

a frame;

at least one beam rotatably supported on the frame and configured to have yarn wound therearound, wherein each beam of the at least one beam has opposed longitudinal ends, wherein each beam of the at least one beam comprises at least one sheave groove on at least one longitudinal end of the beam;

a rope having a first end and a second end, wherein each of the first end and second end is fixedly coupled to the frame, wherein the rope defines a rope path between the first end and the second end of the rope, and wherein the rope is received within a portion of at least one of the at least one sheave groove of each beam of the at least one beam; and a tensioning assembly that is configured to selectively cause a predetermined braking tension in the rope, wherein the tensioning assembly comprises:

a movable sheave that is in engagement with the rope along the rope path; and a piston that is coupled to the movable sheave and is configured to apply a force to the movable sheave to thereby cause the predetermined braking tension in the rope.

2. The system of claim 1, wherein the tensioning assembly is configured to apply the predetermined braking tension upon receiving a stop signal indicative of the stoppage of operation of a textile machine configured to receive yarn from the at least one beam.

3. The system of claim 2, wherein the tensioning assembly comprises a pneumatic actuator that is configured to receive the stop signal, wherein the pneumatic actuator is configured to actuate upon receiving the stop signal to cause the piston to apply the force to the movable sheave to thereby cause the predetermined braking tension in the rope.

4. The system of claim 3, further comprising the textile machine, wherein the textile machine comprises a stop button, wherein the pneumatic actuator is in electrical communication with the stop button of the textile machine.

5. The system of claim 1, wherein the tensioning assembly is configured to cause a predetermined resistance tension when the tensioning assembly is not applying the predetermined braking tension in the rope, wherein the predetermined resistance tension is less than the predetermined braking tension.

6. The system of claim 5, wherein the tensioning assembly is configured to cause the predetermined resistance tension in the rope after a predetermined duration of causing the predetermined braking tension.

7. The system of claim 5, wherein the tensioning assembly further comprises:

a first pressure regulator that is configured to maintain a first output pressure;

a second pressure regulator that is configured to maintain a second output pressure, wherein the second output pressure is greater than the first output pressure; and a pneumatic actuator in fluid communication with each of the first and second pressure regulators, wherein the pneumatic actuator is configured to selectively apply one of the first output pressure or the second output pressure to the piston.

8. The system of claim 7, wherein the first pressure regulator is a bleed pressure regulator that is configured to allow air pressure between the piston and the first pressure regulator to decrease to the first pressure when the first pressure regulator is in communication with the piston.

9. The system of claim 1, wherein the beam comprises a main body and a pair of end plates positioned at the opposed longitudinal ends of the beam, wherein at least one end plate defines the sheave groove.

10. The system of claim 1, further comprising a quick disconnect coupling in communication with the piston.

11. The system of claim 5, wherein the predetermined resistance tension is less than half of the predetermined braking tension.

12. The system of claim 1, wherein the rope comprises a length of cord made by twisting together strands of fibers.

13. A system comprising:

a frame;

at least one beam rotatably supported on the frame and configured to have yarn wound therearound, wherein each beam of the at least one beam has opposed longitudinal ends, wherein each beam of the at least one beam comprises at least one sheave groove on at least one longitudinal end of the beam;

a coupling element having a first end and a second end, wherein each of the first end and second end is fixedly coupled to the frame, wherein the coupling element defines a coupling element path between the first end and the second end of the coupling element, and wherein the coupling element is received within a portion of at least one of the at least one sheave groove of each beam of the at least one beam; and a tensioning assembly that is configured to selectively cause a predetermined braking tension in the coupling element, wherein the tensioning assembly comprises:

a movable sheave that is in engagement with the coupling element along the coupling element path; and a piston that is coupled to the movable sheave and is configured to apply a force to the movable sheave to thereby cause the predetermined braking tension in the coupling element.

14. The system of claim 13, wherein the coupling element is a rope.

15. The system of claim 13, wherein the coupling element is a cable.

16. The system of claim 13, wherein the coupling element is a strap.

17. The system of claim 13, wherein the tensioning assembly is configured to apply the predetermined braking tension upon receiving a stop signal indicative of the stoppage of operation of a textile machine configured to receive yarn from the at least one beam.

18. The system of claim 17, wherein the tensioning assembly comprises a pneumatic actuator that is configured to receive the stop signal, wherein the pneumatic actuator is configured to actuate upon receiving the stop signal to cause the piston to apply the force to the movable sheave to thereby cause the predetermined braking tension in the coupling element.

* * * * *